US010343364B1

(12) United States Patent
Davis

(10) Patent No.: US 10,343,364 B1
(45) Date of Patent: Jul. 9, 2019

(54) BOX GLUING MACHINE

(71) Applicant: Ellis W. Davis, Cross Lake, MN (US)

(72) Inventor: Ellis W. Davis, Cross Lake, MN (US)

( * ) Notice: Subject to any disclaimer, the term of this patent is extended or adjusted under 35 U.S.C. 154(b) by 796 days.

(21) Appl. No.: 14/215,320

(22) Filed: Mar. 17, 2014

Related U.S. Application Data

(60) Provisional application No. 61/791,699, filed on Mar. 15, 2013.

(51) Int. Cl.
*B65B 43/26* (2006.01)
*B31B 1/62* (2006.01)

(52) U.S. Cl.
CPC ..... *B31B 1/62* (2013.01); *B65B 43/26* (2013.01)

(58) Field of Classification Search
CPC .. B65B 43/26; B31B 1/62; B31B 1/18; B31B 1/88
USPC ..... 493/319, 309, 311, 317, 318, 55, 150; 198/339.1, 345.1, 618, 626.5–626.6
See application file for complete search history.

(56) References Cited

U.S. PATENT DOCUMENTS 2,114,622 A 4/1938 Bergstein
2,654,981 A 10/1953 Stenger
2,979,995 A 4/1961 Bergstein et al.
3,094,827 A 6/1963 Mayer
3,200,563 A 8/1965 Berghgracht et al.
3,253,389 A 5/1966 Miller et al.
3,302,367 A 2/1967 Talarico
3,559,372 A 2/1971 Cerioni
4,354,333 A * 10/1982 McArdle ..... B65B 27/04 53/291
4,460,349 A * 7/1984 Charron ..... B31B 1/00 493/131
4,524,560 A 6/1985 Goodman
5,048,673 A * 9/1991 Lee ..... B65B 43/52 198/832.1
5,063,726 A 11/1991 Boisseau
5,642,599 A 7/1997 Tisma
5,809,746 A * 9/1998 DePuy ..... B65B 43/265 198/728
6,050,063 A * 4/2000 Ford ..... B65B 43/305 493/315

FOREIGN PATENT DOCUMENTS

JP 11292006 A 10/1999

* cited by examiner

*Primary Examiner* — Chelsea E Stinson
(74) *Attorney, Agent, or Firm* — Peter J. Ims; Westman, Champlin & Koehler, P.A.

(57) ABSTRACT

A device supports first and second flaps on a box traveling on a conveyor, the conveyor traveling at a speed in a direction. The device includes a cam track having a selected profile. The device includes a drive mechanism, wherein at least a portion of the drive mechanism travels proximate the cam track in the direction at substantially the speed of the conveyor. First and second mounting blocks are pivotally attached to the drive mechanism, including first and second cam followers for engaging the cam track; first and second fingers; and first and second hooks attached to the first and second fingers and configured to engage and hold the first and second flaps on the box. Relative positions of the first and second fingers with respect to the box change as the drive mechanism travels along the cam track.

10 Claims, 7 Drawing Sheets

BOX GLUING MACHINE

CROSS REFERENCE TO RELATED APPLICATIONS

This application claims the benefit of priority from U.S. Provisional Application Ser. No. 61/791,699, filed Mar. 15, 2013, entitled "Box Gluing Machine," the disclosure of which is fully incorporated by reference herein.

BACKGROUND

Cardboard boxes or cartons are used in many applications to store and transport goods. However due to the increased costs of cardboard, it has become advantageous to reduce the amount of cardboard required to form the box or carton. While it is advantageous to reduce the amount of material required to form a box or carton, the box or carton must still have the necessary structural integrity to protect and retain the goods stored within the box when in transport. Typically boxes that have no support for the inside minor flap cannot be glued and must be taped shut. Also if the flaps are made shorted to reduce material, a gap is created between the flaps and requires double taping. The disclosed device supports the minor flaps so the minor flaps can be compressed for gluing.

SUMMARY

In one aspect, a device supports first and second flaps on a box traveling on a conveyor, the conveyor traveling at a speed in a direction. This device supports the minor flaps so they can be compressed for gluing. The device includes a cam track, wherein at least a portion of the cam track is located above the conveyor, the cam track having a selected profile. The device includes a drive mechanism, wherein at least a portion of the drive mechanism travels proximate the cam track in the direction at substantially the speed of the conveyor. A first mounting block is pivotally attached to the drive mechanism, including a first cam follower for engaging the cam track; a first finger; and a first hook attached to the first finger and configured to engage and support the first flap on the box. A second mounting block is pivotally attached to the drive mechanism, including a second cam follower for engaging the cam track; a second finger; and a second hook attached to the second finger and configured to engage and support the second flap on the box. Relative positions of the first and second fingers with respect to the box change as the drive mechanism travels along the cam track due to the selected profile of the cam track.

In another aspect, a method for supporting first and second flaps on a box traveling on a conveyor, the conveyor traveling at a speed in a direction, includes moving a drive mechanism along a cam track, wherein at least a portion of the cam track is located above the conveyor, the cam track having a selected profile. At least a portion of the drive mechanism travels proximate the cam track in the direction at substantially the speed of the conveyor. The drive mechanism includes a first mounting block pivotally attached to the drive mechanism, including a first cam follower for engaging the cam track; a first finger; and a first hook attached to the first finger and configured to engage and support the first flap on the box. A second mounting block pivotally attached to the drive mechanism includes a second cam follower for engaging the cam track; a second finger; and a second hook attached to the second finger and configured to engage and support the second flap on the box. Relative positions of the first and second fingers with respect to the box change as the drive mechanism travels along the cam track due to the selected profile of the cam track.

In yet another embodiment, a box gluing apparatus includes a conveyor traveling at a speed in a direction; a box including first and second minor flaps and first and second major flaps, the box positioned on the conveyor; a cam track, wherein at least a portion of the cam track is located above the conveyor, the cam track having a selected profile; a drive mechanism, wherein at least a portion of the drive mechanism travels proximate the cam track in the direction at substantially the speed of the conveyor; a first mounting block pivotally attached to the drive mechanism and comprising a first hook configured to engage and support the first minor flap on the box; a second mounting block pivotally attached to the drive mechanism and comprising a second hook configured to engage and support the second minor flap on the box; a glue injector for applying glue to between the first and second minor flaps and first and second major flaps; and a device for folding the first and second major flaps to contact the first and second minor flaps.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

The present disclosure relates to a box or carton gluing machine and method. More particularly, the present disclosure relates to a box gluing machine and its use to support the minor flaps of a box upward, such that the major flaps can be pressed against the minor flaps to glue the major flaps and minor flaps together.

An exemplary box gluing machine includes a cam track that accepts a chain drive, where front and back finger mounting blocks are attached to the chain drive. The front and back mounting blocks move at a speed that substantially equals a movement speed of a box on a conveyor. Initially, the fingers extending from the mounting blocks engage a bottom surface of minor flaps of the box and maintain the minor flaps in a substantially horizontal position. The major flaps are then able to be forced into and retained in a horizontal position such that the major flaps contact the minor flaps, and the contacting flaps are glued together.

The mounting blocks are pivotally mounted to the conveyor chain utilizing pivot pins that are moved with the chain drive. The mounting blocks are also pivotally attached to cam followers that engage the cam track, which has a selected cam profile. Advancement of the mounting blocks along the cam track controls the pivoting of the blocks about the respective pivot connections with the chain drive. This pivoting of the mounting blocks causes fingers extending from the mounting blocks out of a gap formed in the closed box to disengage the fingers from an interior of the box. The disclosed device allows for the formation of boxes that use less material than many conventional boxes, therefore saving on the costs of the raw materials needed to construct the box or carton, and allow boxes that are not full to be glued instead of taped.

Figure 1D:
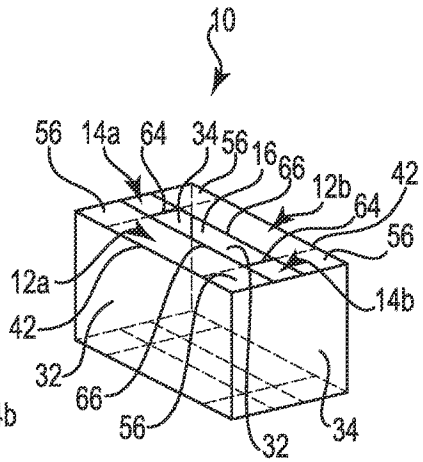
FIG. 1D is a perspective view of the box of FIG. 1C with its minor and major flaps folded horizontally.
Figure 1C:
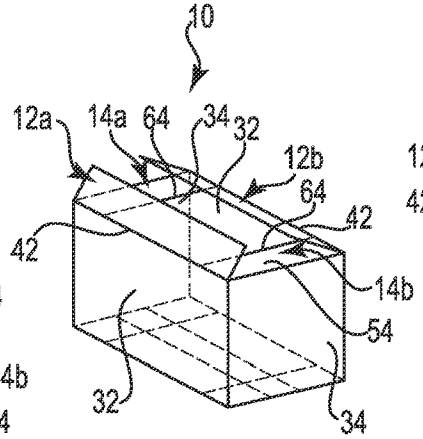
FIG. 1C is a perspective view of the box of FIG. 1B with its minor flaps folded horizontally and its major flaps folded inward.
Figure 1B:
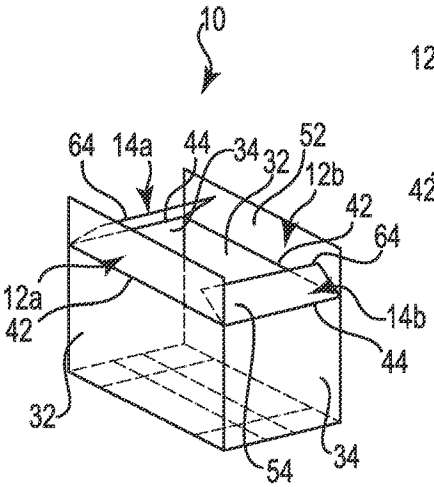
FIG. 1B is a perspective view of the box of FIG. 1A with its minor flaps folded inward.
Figure 1A:
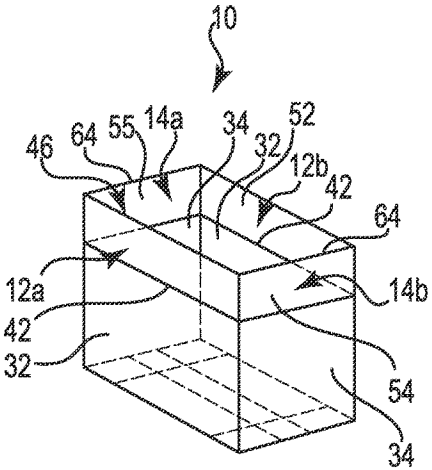
FIG. 1A is a perspective view of a box with its flaps raised.

A sequence for forming a cardboard box or carton 10 is generally illustrated in FIGS. 1A-1D. In FIG. 1A, the box 10 has its major flaps 12*a*, 12*b* and minor flaps 14*a*, 14*b* in a raised position, so that the major flaps 12*a*, 12*b* and minor flaps 14*a*, 14*b* are substantially co-planar with major box sides 32 and minor box sides 34. In an exemplary embodiment, the box 10 is rectangular, and the term "major" designates the box side or flap with the longer dimension; the term "minor" designates the box side or flap with the shorter dimension. However, it is to be understood that these designations are for convenience of reference only, and box 10 may also be square or have another shape.

In an exemplary embodiment, major flaps 12*a* and 12*b* are typically continuous from major side 32, with the demarcation between major flaps 12*a*, 12*b* and major side 32 at fold line 42. Similarly, minor flaps 14*a* and 14*b* are typically continuous from minor side 34, with the demarcation between minor flaps 14*a*, 14*b* and minor side 34 at fold line 44. A vertical dimension of major flaps 12*a*, 12*b* is equal to a vertical dimension of minor flaps 14*a*, 14*b*. Accordingly, the cut edge 46 positioned at the upper extremity of major flaps 12*a*, 12*b* and minor flaps 14*a*, 14*b* is a straight, continuous line. In an exemplary embodiment, the same configuration of flap folding is used at the bottom of box 10. Thus, an exemplary box 10 is formed from a rectangular piece of material, also referred to as a cardboard blank. Such rectangular configurations can be efficiently placed on a stock supply sheet of cardboard material, thereby utilizing the material most economically. In other words, more boxes can be cut from a given piece of stock material, compared to other cut patterns that require irregular cut-outs for flaps, for example.

In FIG. 1B, the minor flaps 14*a* and 14*b* are shown folded inwardly along fold lines 44. Referring to FIG. 1C, the minor flaps 14*a* and 14*b* are folded horizontally, and major flaps 12*a*, 12*b* are folded inwardly along fold lines 42. Without an upward supporting force on the minor flaps 14*a* and 14*b*, it is difficult to glue the major flaps 12*a* and 12*b* to the minor flaps 14*a* and 14*b* utilizing a gluing machine, as the minor flaps 14*a*, 14*b* may be depressed past the horizontal position and into an interior of box 10.

In an exemplary embodiment, glue is injected so that, as shown in FIG. 1D, major flaps 12*a* and 12*b* are folded horizontally for contact with minor flaps 14*a* and 14*b* and retained in the closed configuration as the glue sets or cures. The carton 10 has an improved construction with less material than conventional boxes is illustrated. The carton 10 includes minor flaps 14*a* and 14*b* that partially extend towards each other when folded and have a significant gap 16 between their inner edges 64. The major flaps 12*a* and 12*b* also have a gap 16 between their inner edges 66. By having a gap 16, less material is required to construct box 10 compared to a conventional box that does not exhibit gap 16 when the flaps are folded. The material savings allow the box or carton 10 to be manufactured using less material and therefore less cost. In an exemplary embodiment, box 10 is sealed by gluing major flaps 12*a*, 12*b* and minor flaps 14*a*, 14*b* together at flap overlap regions 56.

It has been found that for many products, the configuration of box 10, with gap 16 at the top and bottom surfaces, is sufficient to protect and contain the products. Suitable products include those of a size and/or configuration that allow for packing the product(s) into box 10 in a manner that prevents the passage of the product(s) through gap 16. For such products, using a box 10 constructed in accordance with this disclosure leads to considerable savings in materials and cost compared to conventional fully closed boxes.

Figure 2:
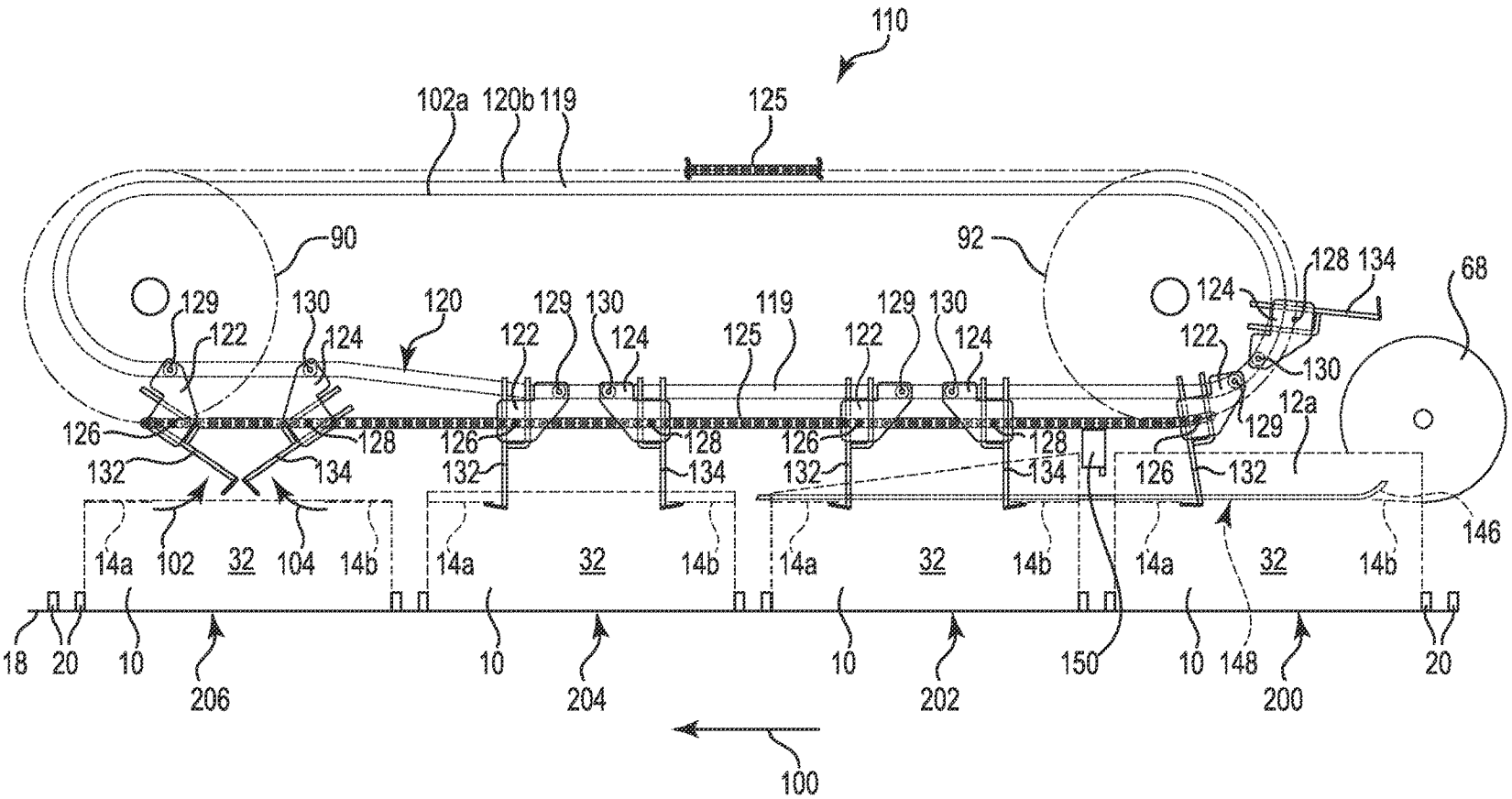
FIG. 2 is a schematic view of a supporting device for retaining the minor flaps, the supporting device including a conveyor that moves boxes and a cam track carrying minor flap engaging fingers.

FIG. 2 shows an apparatus that can be used to automate production of box 10 shown in FIGS. 1A-1D. FIG. 2 is a schematic view of a supporting device 110 for retaining the minor flaps 14*a*, 14*b* in a substantially horizontal position while major flaps 12*a*, 12*b* are brought into contact with minor flaps 14*a*, 14*b*. In an exemplary embodiment, supporting device 110 includes two gears 90, 92 at opposing loop ends of cam track 120. Supporting device 110 also includes conveyor 18 that moves boxes 10 in direction 100 under cam track 120. In an exemplary embodiment, gears 90, 92 move a drive chain 125 in a loop or other closed or recirculating path around a fixed cam track 120. Drive chain 125 carries minor flap engaging fingers 132, 134.

Cam track 120 has interior path 119 with a desired camming profile, as provided between inner cam track 120*a* and outer cam track 120*b*. In an exemplary embodiment, gears 90, 92 move drive chain 125 at substantially the same speed in direction 100 as the speed of conveyor 18 carrying boxes 10. In an exemplary embodiment, conveyor 18 includes spacers 20 to maintain boxes 10 in desired positions on conveyor 18 relative to cam track 120.

Mounting blocks 122 and 124 are pivotally mounted to the chain drive 125 with pivot pins 126 and 128. While chain drive 125 is illustrated in segments for ease of viewing, it is to be understood that in an exemplary embodiment, chain drive 125 is configured in a continuous loop around gears 90, 92 and cam track 120. Cam followers 129, 130 engage upper cam track 120*a* and lower cam track 120*b*, wherein cam follower 129 is attached to mounting block 122 and cam follower 130 is attached to mounting block 124. Cam followers 129, 130 roll along the interior cam path 119 of cam track 120 and cause the blocks 122 and 124 to pivot about their respective pivot pins 126 and 128 into selected positions at selected locations relative to the conveyor 18.

In FIG. 2, only four sets of mounting blocks 122, 124 are illustrated. However, it is to be understood that in an exemplary embodiment, sets of mounting blocks 122, 124 are provided continuously around chain drive 125. Moreover, while only four boxes 10 are shown, it is to be understood that in an exemplary embodiment, a supply of boxes 10 is continuously provided as conveyor 18 travels in direction 100. As gears 90, 92 are driven to rotate in a clockwise direction, chain drive 125 is carried around cam track 120, with a bottom portion of chain drive 125 moving in direction 100. Mounting blocks 122, 124 are pivotally attached to chain drive 125 at pivot pins 126, 128, respectively, to travel therewith. Moreover, cam followers 129, 130 of mounting blocks 122, 124, respectively, pivotally attach a top portion of mounting blocks 122, 124 to cam track 120. In an exemplary embodiment, cam followers 129, 130 are in the form of guide rollers that roll within on a path 119 defined by inner cam track 120*a* and outer cam track 120*b*. While a particular direction 100 of movement is illustrated for conveyor 18 and chain drive 125, it is to be understood that the flow may also be in another direction.

At position 200, fingers 132, 134 of mounting blocks 122, 124 are substantially perpendicular to the tangent of chain drive 125. Block 122 carries a finger 132 having a substantially straight and vertical portion 131 and a hook portion 133 at a distal end. In an exemplary embodiment, the hook portion 133 and the substantially vertical portion 131 form an acute angle configured to engage the leading minor flap 14*a* of box or carton 10. Block 124 carries a second finger 134 having a similar construction as finger 132, wherein the fingers 132 and 134 are minor images of each other. In an exemplary embodiment, finger 134 includes a substantially straight and vertical portion 135 and a hook portion 137 that in an exemplary embodiment forms an acute angle substantially equal to the angle of hook 133.

In an exemplary embodiment, as chain drive 125 travels around gear 92, finger 132 enters the interior of box 10. In an exemplary embodiment, trailing minor flap 14*b* is tucked into the box 10 by a trailing minor flap folding mechanism 68, such as overhead tucking wheel or other suitable device. In an exemplary embodiment, trailing minor flap 14*b* is folded down into a substantially horizontal position. In an exemplary embodiment, carton 10 is pre-creased along fold lines 42 and 44 (see FIGS. 1A-1D) to facilitate the folding of major flaps 12*a*, 12*b* and minor flaps 14*a*, 14*b* from major box sides 32 and minor box sides 34, respectively.

Box or carton 10 continues to move along the conveyor 18 and cam followers 129, 130 move along the cam path 119 toward position 202. As leading minor flap 14*a* passes under forward end 146 of minor flap plow 148, the leading minor flap 14*a* is folded inward along fold line 44 (see FIG. 1B). As box 10 advances toward position 202, both leading minor flap 14*a* and trailing minor flap 14*b* are maintained in a folded, substantially horizontal position under minor flap plow 148. In an exemplary embodiment, minor flap plow 148 has a curved and raised forward end 146 to facilitate smooth operation and to catch trailing minor flaps 14*b* that may have raised from their tucked positions. In an exemplary embodiment, minor flap plow 148 is a stationary bar or panel positioned just in front of or behind fingers 132, 134 (in a direction perpendicular to travel direction 100, see FIG. 3) so that minor flap plow 148 does not interfere with the operation of fingers 132, 134 and does not interfere with movement of boxes 10 along conveyor 18 by collision with major flaps 12*a*, 12*b* or otherwise.

Figure 3:
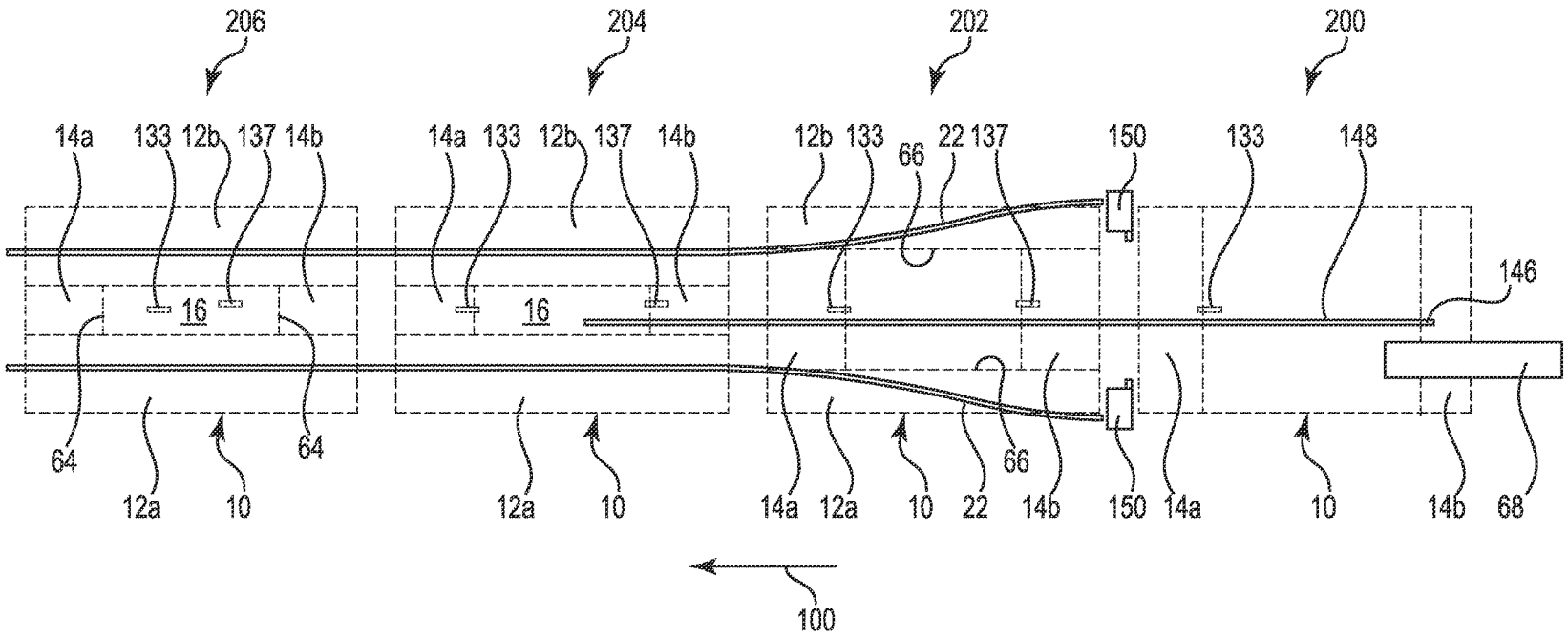
FIG. 3 is a top view of the boxes and some elements of the supporting device, in the configuration of FIG. 2.

As shown in FIG. 3, as box 10 passes from position 200 to position 202, glue injectors 150 are used to apply glue to the upper surface 54 (see FIG. 1C) of minor flaps 14*a*, 14*b*, such as in the overlap regions 56 (see FIG. 1D). As box 10 moves along conveyor 18 in direction 100 to position 202, finger 134 also enters the interior of box 10 to hold up trailing minor flap 14*b*. In an exemplary embodiment, in position 202, box 10 has a configuration such as shown in FIG. 1C, wherein minor flaps 14*a*, 14*b* are held horizontally by fingers 132, 134, respectively, and major flaps 12*a*, 12*b* are in the process of being folded down by major flap plows 152 along fold lines 42. The angle of major flap plows 152, wherein they converge as boxes 10 travel in direction 100, assures smooth operation. In an exemplary embodiment, each major flap plow 152 is a stationary bar positioned at a height and width suitable for the size of boxes 10 in a particular run. The major flap plows 152 are not shown in FIG. 2 for ease of viewing, but it is to be understood that the major flap plows fold down the major flaps 12*a*, 12*b* at position 202 and retain the major flaps 12*a*, 12*b* in their folded configuration at positions 204 and 206 in an exemplary embodiment. In an exemplary embodiment, the major flap plows 152 are static, rigid members that cause the major flaps 12*a*, 12*b* to fold down as box 10 travels in direction 100 under the major flap plows.

Figure 5:
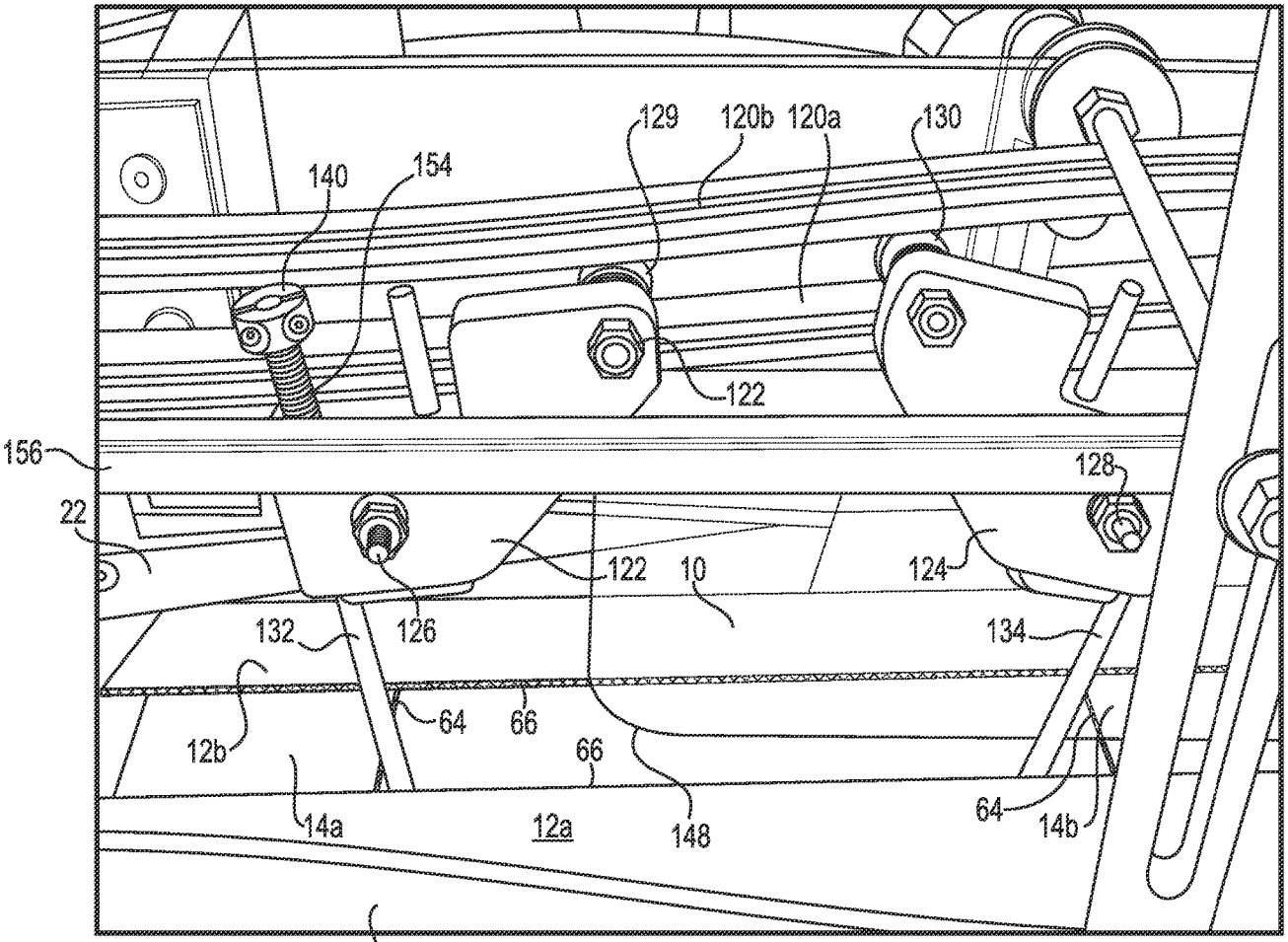
FIG. 5 is a perspective view of a box moving from position 202 toward position 204 of FIGS. 2 and 3.

In position 202, a lower surface 55 (see FIG. 1A) of minor flaps 14*a*, 14*b* contacts hook portions 133, 137 of the fingers 132, 134. The fingers 132 and 134 thereby retain the minor flaps 14*a* and 14*b* in a substantially horizontal configuration as major flaps 12*a*, 12*b* are folded down onto the upper surfaces 54 of minor flaps 14*a*, 14*b*, in contact with the glue injected thereon. FIG. 5 is a perspective view of a box moving from position 202 toward position 204. In FIG. 5, a view of chain drive 125 is obscured by bar 156. A left end of minor flap plow 148 is visible. In the illustrated embodiment, minor flap plow is a transparent panel positioned just behind fingers 132, 134, wherein a bottom surface of the panel exerts a downward force on minor flaps 14*a*, 14*b*. In an exemplary embodiment, minor flap plow is positioned within gap 16 between edges 66 of major flaps 12*a*, 12*b*.

Figure 6:
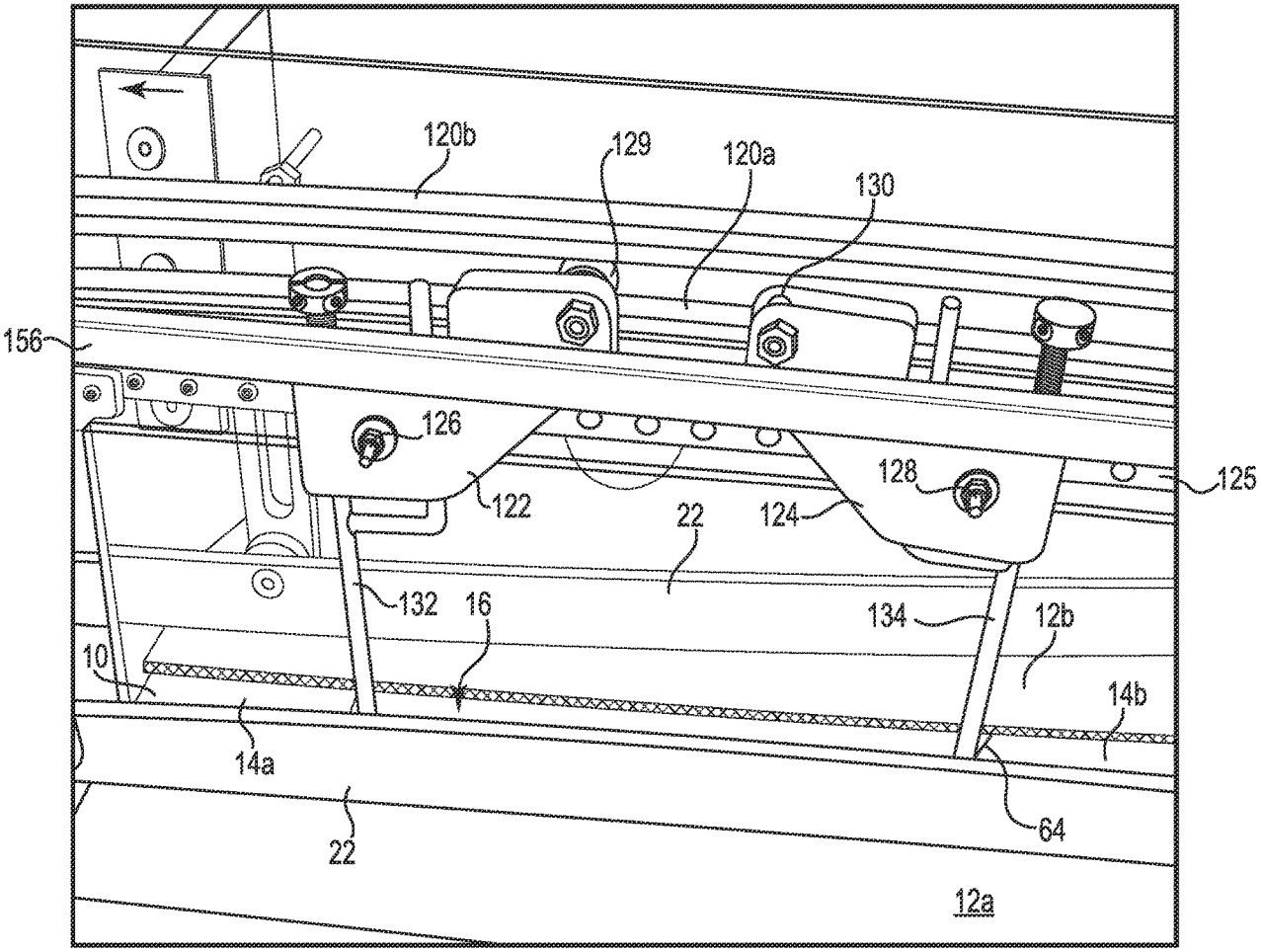
FIG. 6 is a perspective view of a box approximately at position 204 of FIGS. 2 and 3.

FIG. 6 is a perspective view of a box approximately at position 204. In position 204, the lower surface 52 (see FIGS. 1A and 1B) of major flaps 12*a*, 12*b* and the upper surface 54 of minor flaps 14*a*, 14*b* in flap are held in contact so that the glue can set in overlap region 56. In an exemplary embodiment, in position 204, box 10 has the configuration shown in FIG. 1D. As shown in FIG. 6, fingers 132, 134 hold minor flaps 14*a*, 14*b* up; simultaneously, major flap plows 22 hold major flaps 12*a*, 12*b* down.

Figure 7:
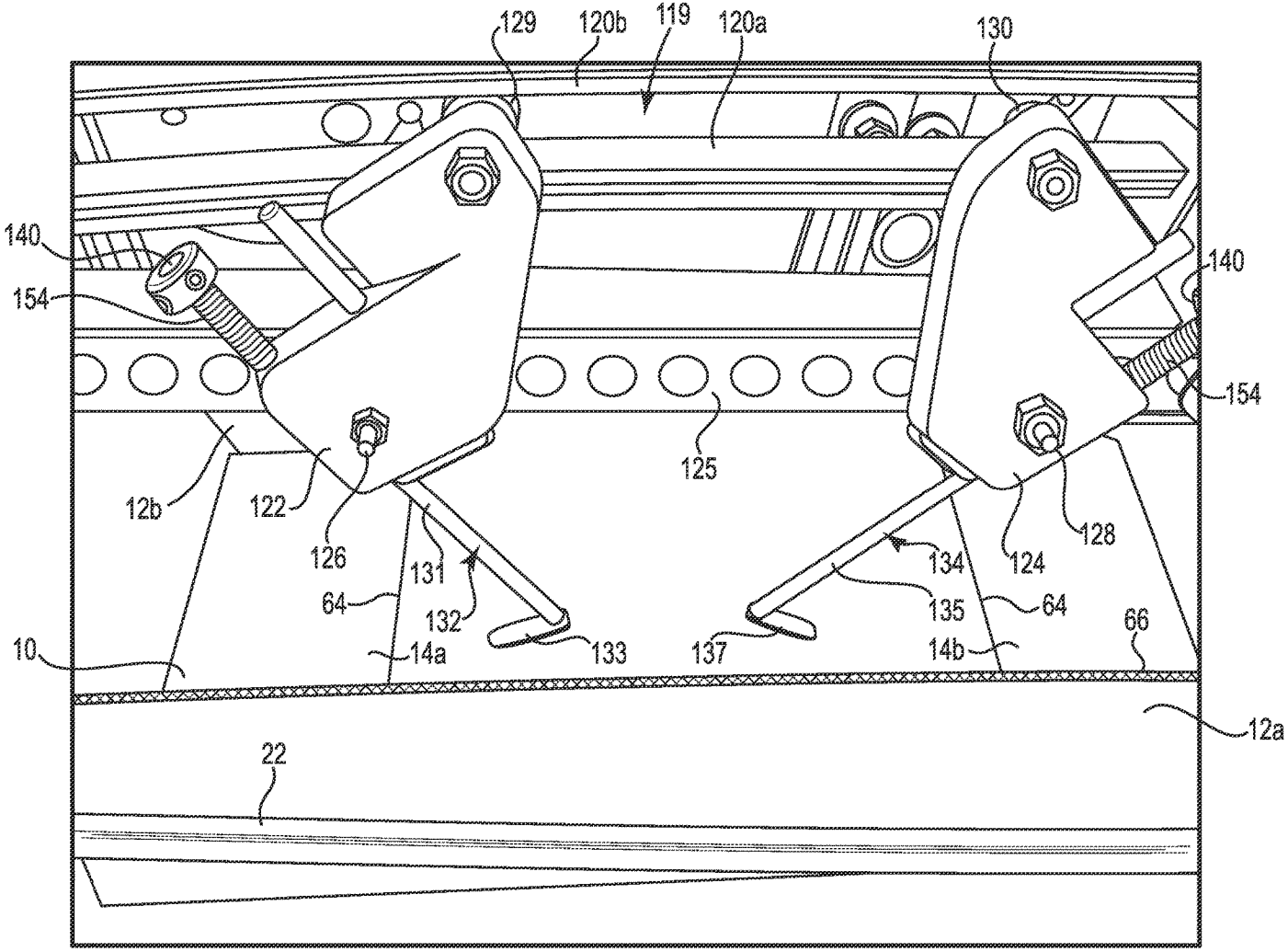
FIG. 7 is a perspective view of the flap engaging fingers in their configuration approximately at position 206 of FIGS. 2 and 3.

Box 10 and mounting blocks 122, 124 continue to position 206. FIG. 7 is a perspective view of the flap engaging fingers 132, 134 in their configuration approximately at position 206, though no glue has been used, and the major flap plows 22 have been moved, so that major flaps 12*a*, 12*b* are opened for a better view of the flap engaging fingers 132, 134. Mounting blocks 122, 124 are pivotally attached to chain drive 125 in a manner that allows mounting blocks 122, 124 to pivot about pivot pins 126, 128 when cam followers 129, 130 travel on cam path 119. Due to the contour of cam path 119 of cam track 120 and the geometry of mounting blocks 122, 124, the fingers 132 and 134 are pivoted toward each other. Such pivoting of fingers 132, 134 allows hooks 133, 137 to clear edges 64 of minor flaps 14*a*, 14*b*. Thus, fingers 132, 134 disengage from minor flaps 14*a* and 14*b* through gap 16.

In particular, with reference to FIG. 2, as mounting block 122 moves from position 204 to position 206, as pulled by chain drive 125, the distance between cam path 119 and chain drive 125 increases; however, the distance between cam follower 129 and pivot pin 126 of mounting block 122 remains the same. Thus, progress of mounting block 122 from position 204 to position 206 causes mounting block 122 to pivot in direction 102, thereby supporting finger 132 from box 10 through gap 16. In an exemplary embodiment, mounting block 124 is a minor image of mounting block 122. Thus, as mounting block 124 moves from position 204 to position 206, as pulled by chain drive 125, the distance between cam path 119 and chain drive 125 increases; however, the distance between cam follower 130 and pivot pin 128 of mounting block 124 remains the same. Thus, progress of mounting block 124 from position 204 to position 206 causes mounting block 124 to pivot in direction 104, thereby supporting finger 134 from box 10 through gap 16. As shown in FIG. 3, in an exemplary embodiment, fingers 132, 134 are slightly offset from each other in a direction perpendicular to travel direction 100. Accordingly, collisions between fingers 132, 134 can be prevented, even though they pivot toward each other.

After the hook portions 133 and 137 disengage minor flaps 14*a* and 14*b*, the fingers 132 and 134 are then raised, following the raised cam track 120, such that the fingers 132 and 134 can be disengaged from the carton 10. Thus, carton 10 is formed having a gap 16 between both the major flaps 12*a* and 12*b* and the minor flaps 12*a* and 12*b*.

Figure 4B:
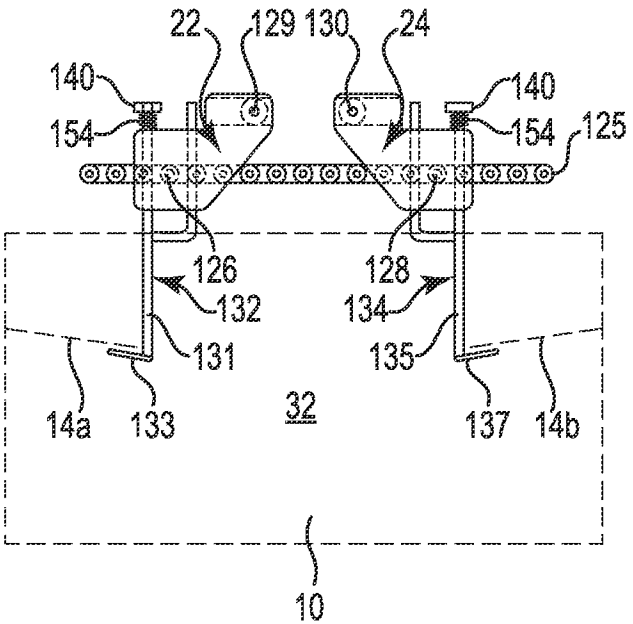
FIG. 4B is a side elevation view of mounting blocks having biasing devices in a compressed configuration.
Figure 4A:
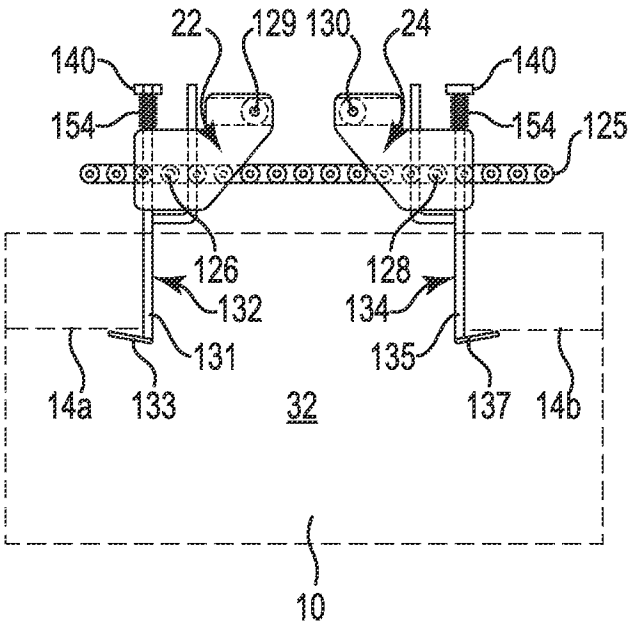
FIG. 4A is a side elevation view of mounting blocks having biasing devices in a normal configuration.

In an exemplary embodiment, as shown in FIGS. 4A and 4B, a biasing device 154 biases each finger 132 and 134 substantially vertically upward. FIG. 4A is a side elevation view of mounting blocks 122, 124 having biasing devices 154 in a normal configuration. FIG. 4B is a side elevation view of mounting blocks 122, 124 having biasing devices 154 in a compressed configuration. In an exemplary embodiment, biasing devices 154 are helical compression springs; however, other biasing devices are contemplated. Thus, fingers 132 and 134 are biased by biasing devices 154 for upward movement of the vertical portions 131 and 135 within the blocks 122 and 124 as the hook portions 133 and 137 engage minor flaps 14*a* and 14*b*. Thus, the minor flaps 14*a*, 14*b* are supported to a substantially horizontal position. In an exemplary embodiment, tension on the biasing devices 154 is adjustable with tensioners 140. In an exemplary embodiment, a tensioner 140 is a bolt having a shaft extending through biasing device 154, wherein the bolt is adjustably threaded into the respective mounting block 122, 124; however, other tensioning devices may also or alternatively be used.

It is to be understood that the disclosed sealing method may be performed on a particular box more than once. For example, the sealing method may first be performed to glue the bottom flaps of the box. Then the box may be inverted, filled with product, and the sealing method may again be performed to glue the top flaps of the box. Additionally, a system incorporating supporting device 110 can have a carton feed mechanism that sets up the boxes, fills the boxes, and glues the boxes closed in one continuous operation.

Although the present invention has been described with reference to preferred embodiments, workers skilled in the art will recognize that changes may be made in form and detail without departing from the spirit and scope of the invention. For example, while the disclosed sealing method is illustrated wherein the minor flaps 14*a*, 14*b* are supported by fingers 132, 134, it is also contemplated that the method may be performed wherein the major flaps 12*a*, 12*b* are supported by fingers 132, 134. In addition, any feature disclosed with respect to one embodiment may be incorporated in another embodiment, and vice-versa.

What is claimed is:

1. A device for supporting first and second flaps in substantially horizontal positions for gluing on a partially filled box traveling on a conveyor, the conveyor traveling at a speed in a direction, the device comprising:

a cam track, wherein at least a portion of the cam track is located above the conveyor, the cam track having a selected profile proximate the conveyor wherein the profile has a first substantially horizontal portion that is a first distance from the conveyor, a second substantially horizontal portion that is a second distance from the conveyor, wherein the first distance is different from the second distance and a non-horizontal portion connecting the first horizontal portion and the second horizontal portion;

a drive mechanism, wherein at least a portion of the drive mechanism is configured to travel proximate the cam track in the direction at substantially the speed of the conveyor;

a first mounting block pivotally attached to the drive mechanism, comprising:

a first cam follower configured to engage the cam track;

a first finger attached to the first cam follower; and a first hook attached to the first finger and configured to engage a bottom surface of the first flap and upwardly support the first flap in the substantially horizontal position on the box wherein the first cam follower is configured to engage the cam track and pivot the first finger and the first hook downwardly such that the first hook engages the bottom surface of the first flap to retain the first flap in the substantially horizontal position; and a second mounting block pivotally attached to the drive mechanism, comprising:

a second cam follower configured to engage the cam track;

a second finger attached to the second cam follower; and a second hook attached to the second finger and configured to engage a bottom surface of the second flap and upwardly support the second flap in the substantially horizontal position on the box wherein the second cam follower is configured to engage the cam track and pivot the second finger and the second hook downwardly such that the second hook engages the bottom surface of the second flap to retain the second flap in the substantially horizontal position wherein the first and second flaps are substantially planar such that third and fourth flaps can be secured to upper surfaces of the first and second flaps;

wherein relative positions of the first and second fingers with respect to the box change as the drive mechanism travels along the cam track due to the selected profile of the cam track such that the first and second finger are removed from the box after the third and fourth flaps are secured to the upper surfaces of the first and second flaps.

2. The device of claim 1 wherein:

at the first position, the cam track is located a first distance from the conveyor; and at the second position, the cam track is located a second distance from the conveyor, wherein the second distance is greater than the first distance.

3. The device of claim 1 wherein:

at the first position, the first hook is located a first distance from the second hook; and at the second position, the first hook is located a second distance from the second hook, wherein the second distance is less than the first distance.

4. The device of claim 1 wherein:

at the first position, the cam track is located a first distance from the drive mechanism; and at the second position, the cam track is located a second distance from the drive mechanism, wherein the second distance is greater than the first distance.

5. The device of claim 1 wherein at the first position, the first and second fingers are oriented substantially vertically.

6. The device of claim 1 wherein the first finger comprises a straight portion and the first hook, and wherein the first hook is attached to the straight portion at an acute angle.

7. The device of claim 1 wherein the cam track is a closed loop.

8. A box gluing apparatus comprising:

a conveyor configured to travel at a speed in a direction;

a partially filled box having an open space at a top portion of the box and comprising first and second minor flaps located at opposing first and second sides of the box and first and second major flaps located at opposing third and fourth sides of the box, the box configured to be positioned on the conveyor;

a cam track, wherein at least a portion of the cam track is configured to be located above the conveyor, the cam track having a selected profile;

a drive mechanism, wherein at least a portion of the drive mechanism is configured to travel proximate the cam track in the direction at substantially the speed of the conveyor;

a first mounting block pivotally attached to the drive mechanism and comprising a first hook configured to engage a bottom surface of the first minor flap on the box and upwardly support the first minor flap in a substantially horizontal position on the box;

a second mounting block pivotally attached to the drive mechanism and comprising a second hook configured to engage a bottom surface of the second minor flap on the box and upwardly support the second minor flap in a substantially horizontal position on the box such that the bottom surfaces of the first and second minor flaps are substantially planar;

a glue injector configured to apply glue to either the first and second minor flaps or the first and second major flaps; and a device for configured to fold the first and second major flaps to contact the first and second minor flaps such that the glue is compressed between the major and minor flaps to retain the major and minor flaps together.

9. The apparatus of claim 8, wherein relative positions of the first and second hooks with respect to the box change as the drive mechanism travels along the cam track due to the selected profile of the cam track.

10. The apparatus of claim 8 wherein the cam track is a closed loop.

* * * * *